US009511824B2

(12) United States Patent
Sturges et al.

(10) Patent No.: US 9,511,824 B2
(45) Date of Patent: Dec. 6, 2016

(54) AUTOMATED CABLE BREAKOUT ASSEMBLY

(71) Applicant: Raytheon Company, Waltham, MA (US)

(72) Inventors: James R. Sturges, Tiverton, RI (US); Haywood Hartwell, Bristol, RI (US); David A. Sharp, Newport, RI (US); Christopher Blake, Swansea, MA (US); Joseph Ricci, Jr., Bristol, RI (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/942,640

(22) Filed: Nov. 16, 2015

(65) Prior Publication Data

US 2016/0137270 A1 May 19, 2016

Related U.S. Application Data

(60) Provisional application No. 62/081,935, filed on Nov. 19, 2014.

(51) Int. Cl.

| | |
|---|---|
| ***B63B 21/04*** | (2006.01) |
| ***B63B 21/56*** | (2006.01) |
| ***H01R 39/64*** | (2006.01) |
| *B63G 8/42* | (2006.01) |

(52) U.S. Cl.
CPC ..... *B63B 21/56* (2013.01); *B63B 21/04* (2013.01); *H01R 39/643* (2013.01); *B63G 8/42* (2013.01)

(58) Field of Classification Search
CPC ..... B63B 21/04; B63B 21/56; B63B 21/66; B63G 8/39; B63G 8/42
USPC ..... 114/230.28, 253
See application file for complete search history.

(56) References Cited

U.S. PATENT DOCUMENTS

| | | | |
|---|---|---|---|
| 1,613,825 | A | 1/1927 | Harmon |
| 2,753,408 | A | 7/1956 | Tuchel |
| 3,082,396 | A | 3/1963 | Bernhard |
| 4,239,325 | A | 12/1980 | Tyson |
| 8,104,419 | B2 | 1/2012 | Coupeaud et al. |

FOREIGN PATENT DOCUMENTS

| | | |
|---|---|---|
| GB | 795322 | 5/1958 |
| WO | WO 88/10525 | 12/1988 |

OTHER PUBLICATIONS

International Search Report dated Jan. 27, 2016 in connection with International Patent Application No. PCT/US2015/061404; 5 pages.

(Continued)

*Primary Examiner* — Lars A Olson

(57) ABSTRACT

A method of engaging an automated breakout assembly includes receiving, by a tow socket having a rotatable sleeve multiple mating connectors, a cable into the tow socket through a slot. The cable comprises a tow ball. Each mating connector is electrically coupled to an electrical conductor. The method includes receiving, by the rotatable sleeve, the randomly-aligned tow ball through an entrance. The method includes rotating a cam configured to rotate the rotatable sleeve to substantially align the mating connectors of the tow socket with connectors of the tow ball such that each electrical conductor electrically coupled to a mating connector couples to a corresponding connector of the tow ball. The method includes transferring a tow loading force between the cable and the tow socket by moving the cable.

20 Claims, 15 Drawing Sheets

(56) References Cited

OTHER PUBLICATIONS

International Written Opinion dated Jan. 27, 2016 in connection with International Patent Application No. PCT/US2015/061404; 7 pages.

AUTOMATED CABLE BREAKOUT ASSEMBLY

CLAIM OF PRIORITY

This application claims priority of U.S. Provisional Patent Application Ser. No. 62/081,935, filed on Nov. 19, 2014, entitled "AUTOMATED CABLE BREAKOUT ASSEMBLY" the teachings of which are incorporated herein by reference.

TECHNICAL FIELD

The present disclosure is directed to towing systems, and more specifically to an automated cable breakout assembly for use with a towing system.

BACKGROUND OF THE DISCLOSURE

In various applications, it may be necessary or desirable to tow multiple vehicles or other bodies behind a vessel. For example, a ship, submarine, or other naval vessel may use multiple bodies to support towed sonar array applications or other applications. As a particular example, one or more towed bodies could include transmit arrays, and one or more other towed bodies could include receive arrays. The transmit arrays generate acoustic signals that reflect off objects and return to the receive arrays. In order to connect multiple bodies to a vessel for towing, separate tow cables are often needed, which increases the complexity and cost of the overall system.

SUMMARY OF THE DISCLOSURE

This disclosure provides an automated breakout assembly (ABA) and method for engaging the ABA.

In a first example, a system includes a body. The body includes a tow socket configured to receive a randomly-aligned tow ball. The tow socket includes a rotatable sleeve, a cam, and multiple mating connectors. Each mating connector is electrically coupled to an electrical conductor. The system further includes a cable configured to be coupled to the body in order to facilitate towing of the body. The cable includes multiple core connectors and multiple breakout connectors configured to transport signals. The cable further includes a tow ball configured to enter the rotatable sleeve of the tow socket. The tow ball includes connectors configured to couple the breakout connectors of the cable to the mating connectors of the tow socket. The cam is coupled to the rotatable sleeve and configured to rotate the rotatable sleeve to substantially align the mating connectors of the tow socket with connectors of a tow ball such that each electrical conductor electrically coupled to a mating connector couples to a corresponding connector of the tow ball.

In a second example, an apparatus includes a tow socket configured to receive a randomly-aligned tow ball. The tow socket includes a rotatable sleeve, a cam, and multiple mating connectors. Each mating connector is electrically coupled to an electrical conductor. The cam is coupled to the rotatable sleeve. The cam is configured to rotate the rotatable sleeve to substantially align the mating connectors of the tow socket with connectors of a tow ball such that each electrical conductor electrically coupled to a mating connector couples to a corresponding connector of the tow ball.

In a third example, a method includes receiving, by a tow socket having a rotatable sleeve and multiple mating connectors, a cable into the tow socket through a slot. The cable comprises a tow ball. Each mating connector is electrically coupled to an electrical conductor. The method includes receiving, by the rotatable sleeve, the randomly-aligned tow ball through an entrance. The method includes rotating a cam to rotate the rotatable sleeve to substantially align the mating connectors of the tow socket with connectors of the tow ball such that each electrical conductor electrically coupled to a mating connector couples to a corresponding connector of the tow ball. The method includes transferring a tow loading force between the cable and the tow socket by moving the cable.

Other technical features may be readily apparent to one skilled in the art from the following figures, descriptions, and claims.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
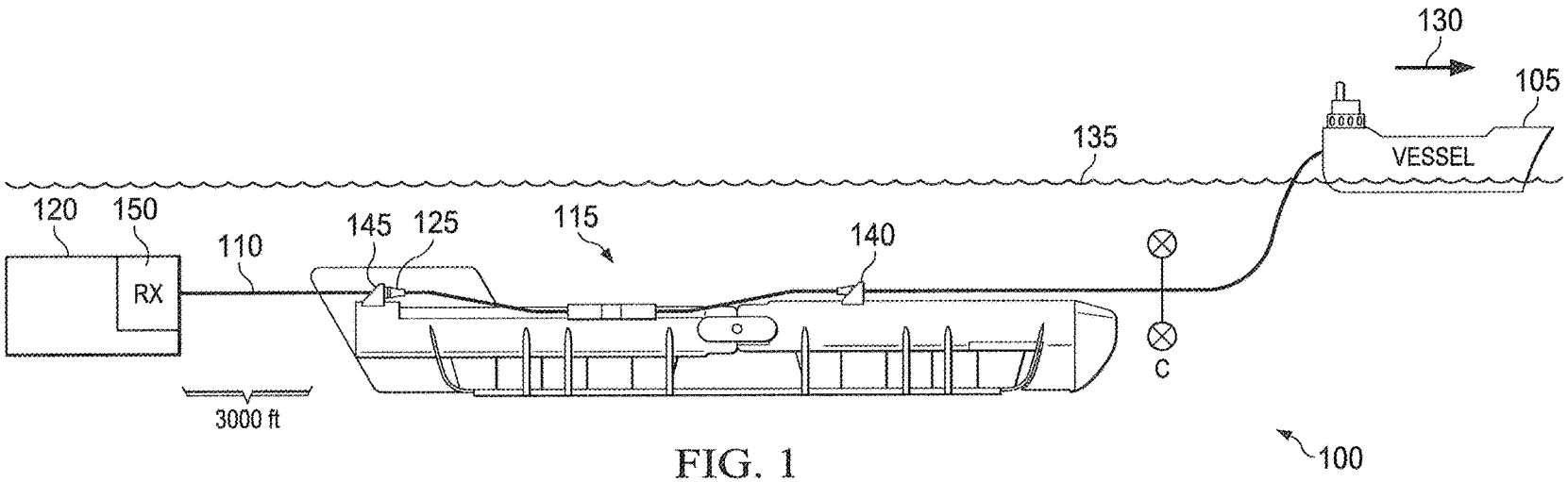
FIG. 1 illustrates an example of a towing system according to embodiments of the present disclosure.

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

This disclosure provides an automated cable breakout assembly that can be used to connect multiple vehicles or other bodies to a vessel using a single tow cable. The automated cable breakout assembly also provides an automated interconnection, meaning little or no human intervention may be required to properly align a towed vehicle or other body to a connector on the tow cable. Further, the automated cable breakout assembly allows for interconnection at any mid-point of a tow cable, meaning signals can be received from or provided to the tow cable at various points between the ends of the tow cable. In addition, implementing the automated cable breakout assembly (ABA) with the design features described herein will reduce or eliminate the risk of cable damage due to mating rotational alignment and/or towed body rotation due to rotational stiffness of the tow cable.

These or other benefits can be obtained via the use of a tow ball that structurally anchors a cable. The tow ball has embedded connectors that rotationally align with mating connectors embedded in a tow socket, which is fixed to a towed vehicle or other towed body. When a randomly-aligned tow ball enters the tow socket, a cam follower of the tow ball drives a rotation cam fixed to a rotation sleeve in the tow socket to achieve rotational alignment. Mating occurs via (drag) tension in the tow cable.

Among other things, example novel features of this approach include the tow socket's rotation sleeve and its peripheral hardware, which allow for automated interconnection without cable damage and/or towed body rotation once the towed vehicle or other body is launched. Other novel features include a low-friction rotation sleeve with its integral cam and embedded socket connectors, plus a flexible cable wired to the connectors in the socket and its return mechanism that re-align the cable entry slots of the outer housing with the inner rotation sleeve.

Additional details regarding one example implementation of the automated cable breakout assembly are provided below. The automated cable breakout assembly could be used in any suitable application, such as in towed array sonar applications or other applications where multiple vehicles or other bodies are towed using a common tow cable. Examples of towed sonar array applications where the automated cable breakout assembly disclosed herein could be used to couple vessels to towed vehicles or other bodies are disclosed in U.S. Pat. No. 6,683,819 and U.S. Pat. No. 7,046,582 (both of which are hereby incorporated by reference). However, the automated cable breakout assembly disclosed here could be used in any other suitable applications, including military and commercial applications. Example applications could include towed array sonar applications for submarine detection, search and rescue operations, underwater navigation, or underwater mapping applications.

FIG. 1 illustrates an example of a towing system 100 according to embodiments of the present disclosure. In the towing system 100, a vessel 105 tows one or more bodies that communicate signals to each other through a single cable that mechanically tethers the bodies to each other and to the vessel. Various components of the towing system form an automated breakout assembly (ABA) to achieve an electrical breakout interconnection and load transfer between a tow cable 110 and one or more towed bodies 115-120. The towing system 100 includes the vessel 105, the tow cable 110, one or more towed bodies 115-120, and at least one ABA 125. The towing system 100 can include towed bodies connected in series, such that one towed body leads another towed body, and the other towed body trails its leader. In the example shown, the towed body 115 represents a leading towed body, and the towed body 120 represents a trailing towed body. In a specific example, the distance between the leading towed body 115 and the trailing towed body 120 can be several thousand feet.

An auxiliary tow ball at the forward tow point 140 is a component that enables certain functions of the ABA 125 as described herein. The auxiliary tow ball at the forward tow point 140 bears the drag loading of the towed body 115 and all that is towed behind it. This enables the cable between the ABA tow ball (i.e., tow ball within the ABA 125) and the auxiliary (forward) tow ball to be slack during towing operations and enables the ABA tow ball to remain engaged by the drag force of the trailing towed body 120.

The vessel 105 tows the towed bodies 115-120 in a forward direction 130 by using the tow cable 110. The vessel 105 can float on the surface 135 of a body of liquid, such as water in an ocean or lake. A host ship is an example of the vessel 105.

The tow cable 110 tethers the towed bodies 115-120 to each other and to the vessel 105, restricting movement in undesired directions. The tow cable 110 extends from the vessel 105 to various tow points on the leading towed body 115, and further to a tow point of the trailing towed body 120. The tow cable 110 is coupled (i.e., connected or mechanically attached) to the vessel 105 and each of the towed bodies 115-120. That is, the tow cable 110 includes one end that is coupled to the vessel 105, and another end that is attached to the trailing towed body 120. The tow cable 110 also includes one or more tow balls (described more particularly below) that each form a portion of an ABA 125 for interconnecting any mid-point of the tow cable 110 to a towed body 115-120. The tow cable 110 is a single cable, wherein the line C represents a location for a lateral cross-section of the tow cable 110. The circle with an "x" through the center represents a direction into the page for the cross-section cut along the line C.

The towing system 100 can be an underwater towing system, wherein the leading towed body 115 and the trailing towed body 120 are submerged during a towing operation. The leading towed body 115 includes a forward tow point 140, a hull, and an aft tow point 145 to which mid-points of the tow cable 110 connect. The leading towed body 115 includes a transmit array configured to accept a sound navigation and ranging (SONAR) transmit signal from the towing vessel 105 through the tow cable 110. Correspondingly, the trailing towed body 120 includes a forward tow point to which the end of the tow cable 110 connects, and a receive array 150 configured to transmit SONAR signals to and accept power from the towing vessel 105.

The zoomed-in portion of FIG. 1 shows the ABA 125 at a closer point of view. In this embodiment, the ABA 125 transfers load between the tow cable 110 and the leading towed body 115. That is, the ABA 125 is formed from the tow ball of the tow cable 110 and a tow socket of the leading towed body 115.

Although FIG. 1 illustrates one example of a towing system 100, various changes may be made to FIG. 1. For example, the relative sizes, shapes, and dimensions of the various components shown in FIG. 1 are for illustration only. Each component in FIG. 1 could have any other size, shape, and dimensions.

Figure 2:
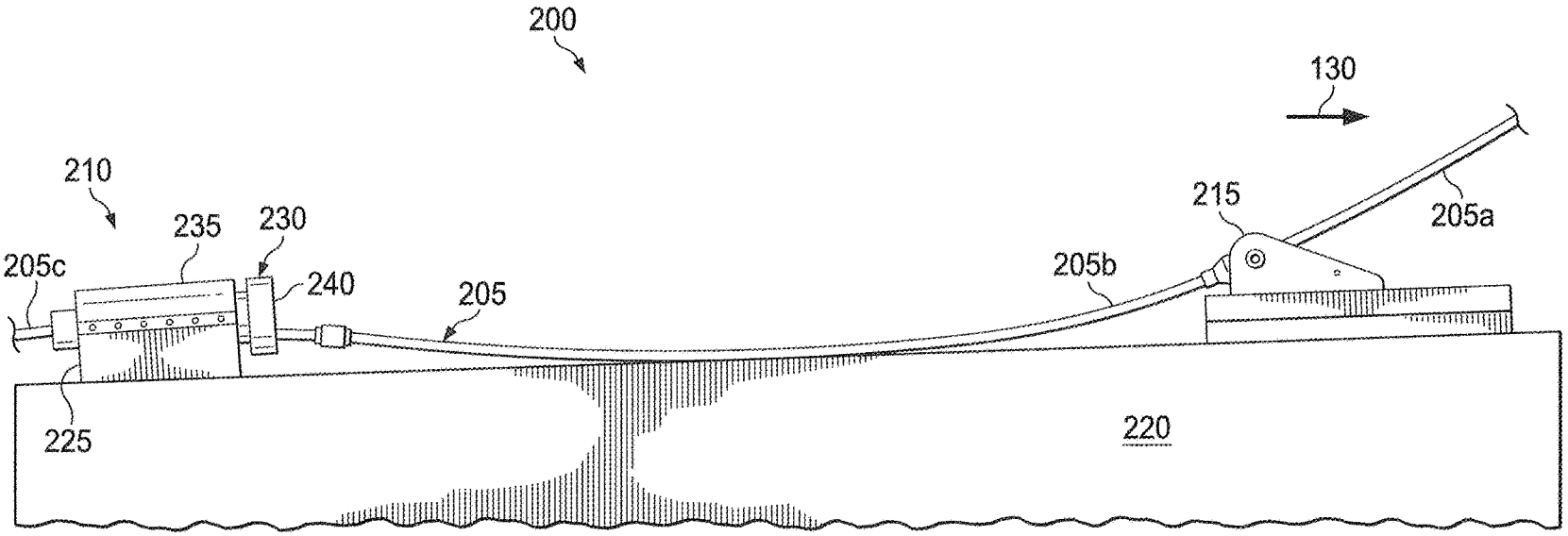
FIG. 2 illustrates an example of a leading towed body coupled to a tow cable via an automated breakout assembly according to embodiments of the present disclosure.

FIG. 2 illustrates an example of a leading towed body 200 coupled to a tow cable 205 via an automated breakout assembly 210 according to embodiments of the present disclosure. For ease of explanation, the leading towed body 200 is described as being used in the towing system 100 of FIG. 1. However, the leading towed body 200 could be used in any other suitable system.

The leading towed body 200 includes a forward tow point 215, a hull 220, an aft tow point 225, and a transmit array. The ABA 210 is mounted to the aft tow point 225 and is configured to connect the aft tow point 225 to a mid-point of the tow cable 205. An auxiliary tow ball that is forward-bearing at the forward tow point 215 is a part of the cable 205 and is spaced a distance from the ABA 210 that is greater than the distance between the aft and forward tow points 225 and 215.

The leading towed body 200 and tow cable 205 could, for example, be used in the towing system 100 of FIG. 1. For example, the forward direction 130 indicates the direction toward which a vessel, such as the vessel 105, tows the leading towed body 200, bearing the drag loading at tow point 215. Note that components 210, 215, 220, and 225 in FIG. 2 could be the same as or similar to corresponding components 125, 140, the hull, and 145 in FIG. 1. These components in FIG. 2 can operate in the same or similar manner as the corresponding components in FIG. 1.

The zoomed-in portion of FIG. 2 shows the ABA 210 at a close point of view. As shown, the ABA 210 is in an engaged state, where the tow ball of the tow cable 205 is electrically and mechanically coupled to the tow socket 230 of the leading towed body 200. The tow socket 230 of the leading towed body 200 includes an outer housing 235 forming a fixed sleeve into which the tow ball of the tow cable 205 can slide into for engaging or slide out of for disengaging the tow ball of the tow cable 205. The tow socket 230 also includes a front plate 240 fastened to a front of the outer housing 235 and providing a front surface of the tow socket 230. Internal components of the tow socket 230 include a rotation sleeve, a tow ball receiver that is a component of a tow socket connection assembly, low friction rings, and a cam, each of which are described more particularly below with reference to FIGS. 7B and 8. In the engaged state, as the tow ball of the tow cable 205 is disposed within the sleeve of the tow socket 230, the tow ball is hidden from view from the side perspective of FIG. 2. In the disengaged state, the tow ball of the tow cable 205 is outside of the sleeve of the tow socket 230, and would be visible from the side perspective of FIG. 2.

A first portion 205*a* of the tow cable 205 extends from the forward tow point 215 to the vessel. A second portion 205*b* of the tow cable 205 extends from the forward tow point 215 to the tow socket 230. A third portion 205*c* of the tow cable 205 extends from the tow socket 230 to a tow point of the trailing towed body 120.

Although FIG. 2 illustrates one example of a towed body 200, various changes may be made to FIG. 2. For example, the relative sizes, shapes, and dimensions of the various components shown in FIG. 2 are for illustration only. Each component in FIG. 2 could have any other size, shape, and dimensions.

FIGS. 3 through 12C illustrate details of the ABA 210 of FIG. 2 according to this disclosure. For ease of explanation, the ABA 210 is described as being a component of the leading towed body 200 that is used in the system 100 of FIG. 1. However, the ABA 210 could be used in any other suitable system.

Figure 3:
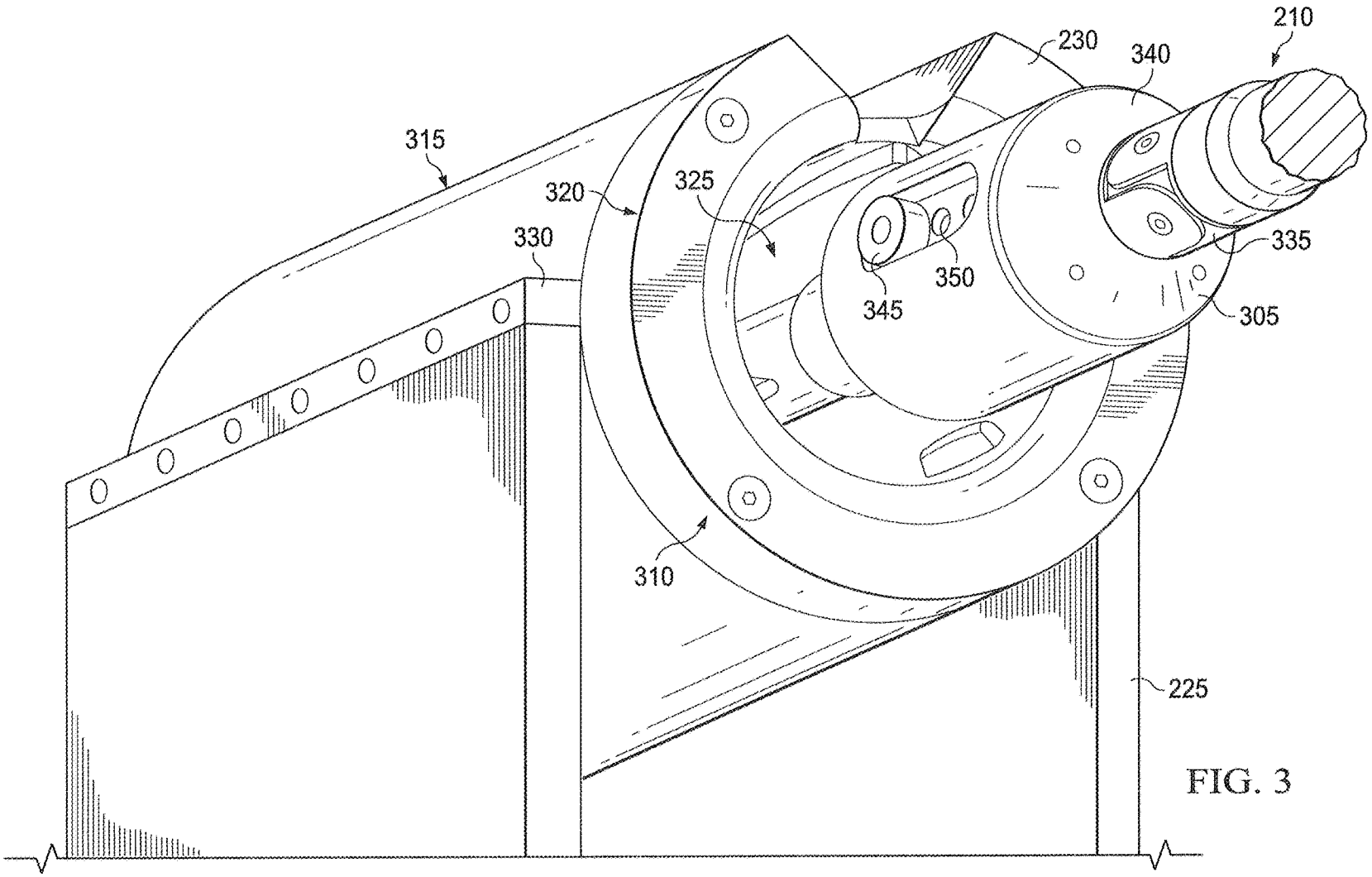
FIG. 3 illustrates the automated breakout assembly (ABA) of FIG. 2 in a disengaged state.

FIG. 3 illustrates the ABA 210 of FIG. 2 in a disengaged state. In the disengaged state, the tow ball 305 of the tow cable 205 is outside of the tow socket 230. In the position shown, the third portion 205*c* of the tow cable 205 is disposed within the tow socket 230, and the tow ball 305 is positioned to be radially aligned with the sleeve.

In this perspective, namely, forward of the tow socket 230 facing aft, an external surface is shown, including the front surface 310 and side surface 315, of the tow socket 230. The external surface of the tow socket 230 has the shape of a circular tube or sleeve with a wedge notch cutout (i.e., slot) at approximately its 12 o'clock position. The wedge notch cutout extends from the front surface 310 to the rear surface of the tow socket 230. The front surface 310 includes an outer circumference 320 at the external surface of the tow socket 230, and an inner circumference 325 formed by a hole through the entire length of the tow socket 230. The inner circumference 325 at the front surface 310 forms an entrance for the tow ball 305 to enter the hole.

The side surface 315 includes the round external surface of the outer housing 235 formed at the outer circumference 320 and a mount rail portion 330 that extends radially outward from the round external surface of the outer housing 235. The mount rail portion 330 allows bolts to fasten the tow socket 230 to the aft tow point 225 by extending vertically through the mount rail portion 330. The mount rail portion 330 is fastened to the outer housing 235 by bolts extending horizontally through the mount rail portion 330. Other methods can be used to attach the tow socket 230 to the aft tow point 225, such as welding.

The tow ball 305 includes multiple cable interfaces configured to connect to the tow cable 205. These cable interface components can function separately or as intrinsic protection, strength members, or U-joint-type bend limiters. More particularly, the tow ball 305 includes a forward cable interface 335 to couple to the second portion 205*b* of the tow cable 205. The tow ball 305 includes a rear cable interface (shown in FIG. 4 by reference number 410) to couple to the third portion 205*c* of the tow cable 205. The forward cable interface 335 can be similar to the rear cable interface 410, namely, including u-joints with a threaded cylinder configured to mate with the second portion 205*b* of the tow cable 205. That is, the second portion 205*b* of the tow cable 205 can connect to the tow ball 305 via the forward cable interface 335 in a same or similar way that the third portion 205*c* connects with the tow ball 305 via the rear cable interface 410.

The tow ball 305 includes a ball member 340 between the forward cable interface 335 and rear cable interface 410. The ball member 340 can have the shape of a cylinder with a front and rear truncated cone on each of its bases (as shown in FIG. 3), or another suitable shape that complements the shape of the internal components of the tow socket 230. The cylinder portion of the ball member 340 includes cam follower 345 disposed within a recess. The cam follower 345 can be a flat head pin that fits into the pin holes 350 within the recess. The pin head of the cam follower 345 protrudes radially outward from the cylinder portion of the external surface of the ball member 340. When the cam follower 345 enters the tow socket 230, the pin head of the cam follower 345 contacts an internal surface of a rotation cam (shown in FIGS. 7A and 7B by reference number 725), thereby initiating a clocking operation. That is, movement of the tow cable 205 in a direction of the longitudinal axis of the ABA 210, such as during a winching operation, causes the tow ball 305 to slide into and interact with the internal components of the tow socket 230.

Figure 4:
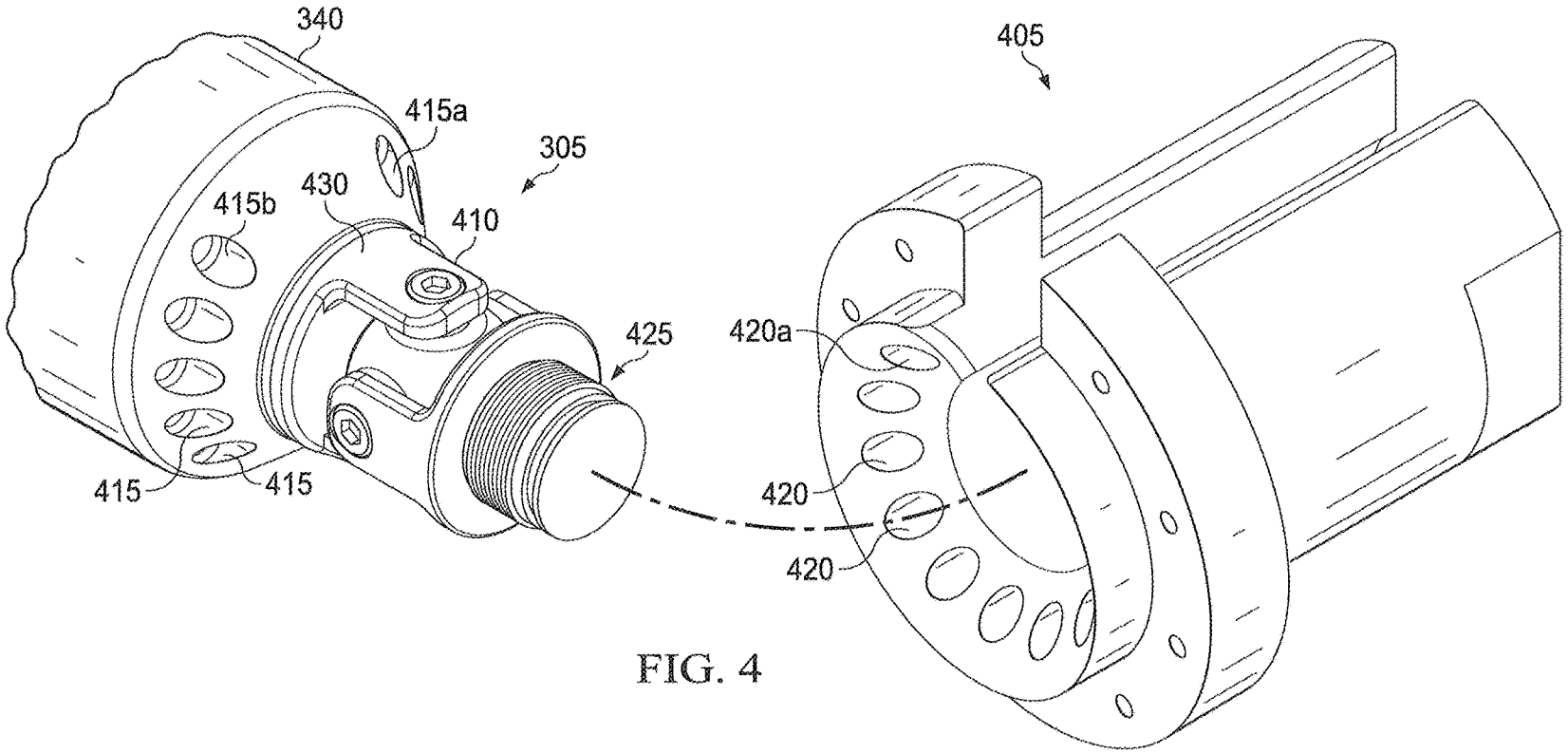
FIG. 4 illustrates a rear of a tow ball facing a front of a tow ball receiver for clocking and mating according to embodiments of the present disclosure.

FIG. 4 illustrates a rear of the tow ball 305 facing a front of a tow ball receiver 405 for clocking and mating according to embodiments of the present disclosure. As shown, the rear of the tow ball 305 includes the rear cable interface 410 and multiple (for example, eleven) pin holes 415 (including pin holes 415*a*-415*b*) within its rear truncated cone; and the 12 o'clock position of the rear truncated cone includes an unpierced portion between pin holes 415*a* and 415*b*. Correspondingly, the front of the tow ball receiver 405 includes the same number (for example, eleven) of pin holes 420 (including pin hole 420*a*) spaced apart from each other by a same interval of pin holes 415 of the tow ball 305. When the pin hole 420*a* immediately beside the wedge notch cutout aligns with the pin hole 415*a*, the 12 o'clock position of the tow socket 230 is clocked into alignment with the 12 o'clock position of the tow ball 305.

Dowel pins (shown in FIG. 7B by reference number 745) can be inserted into pairs of corresponding pin holes to establish accurate final alignment of the tow ball receiver 405 with the tow ball 305. That is, one end of a dowel pin can be inserted into either the pin hole 415*a* or the pin hole 420*a* such that when the tow socket 230 and tow ball 305 are clocked into close alignment as a result of the cam follower in tow ball 305 moving the cam 230, movement of the tow ball 305 toward the tow ball receiver 405 inserts the opposite end of the dowel pin into its mating pin hole (415*a* or 420*a*). As such, the center longitudinal axis of each pin hole 415 can be substantially collinear with the center longitudinal axis of each corresponding pin hole 420.

The rear cable interface 410 includes a threaded end 425 and a u-joint end 430. The threaded end 425 is configured to threadedly attach to the protection/strength member/bend limiter of cable portion 205*c* of the tow cable 205. The u-joint end 430 includes a u-joint end in contact with the rear truncated cone. The u-joint end 430 includes a pin about which the threaded end 425 pivotably attaches to the u-joint end 430.

Although FIG. 4 illustrates one example of a clocking and mating hardware configuration between the tow ball 305 and tow ball receiver 405, various changes may be made to FIG. 4. For example, the relative sizes, shapes, and dimensions of the various components shown in FIG. 4 are for illustration only. Each component in FIG. 4 could have any other size, shape, dimensions, and number of connectors. As another example, other suitable clocking and mating configurations can be used, such as a ball and divot on mating surfaces.

Figure 5:
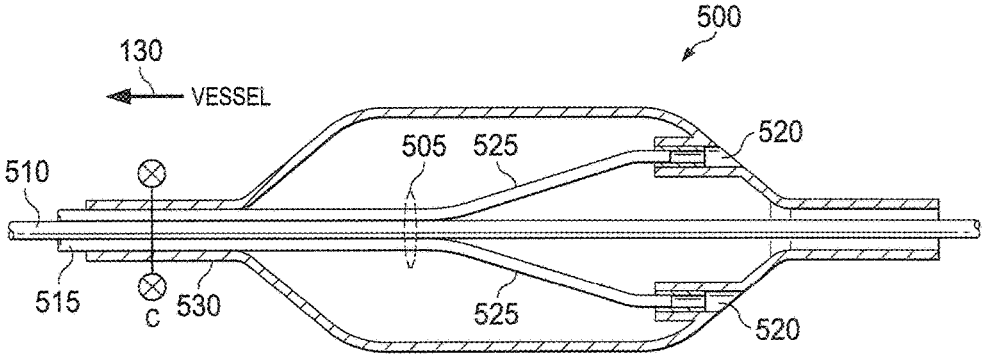
FIG. 5 illustrates a longitudinal cross-section of an example tow ball according to embodiments of the present disclosure.

FIG. 5 illustrates a longitudinal cross-section of an example tow ball 500 according to embodiments of the present disclosure. For ease of explanation, the tow ball 500 of FIG. 5 is described as being a component of the tow cable 205 that is used in the system 100 of FIG. 1.

The tow ball 500 includes conductors 505 throughout its length, from the forward end to the rear end. The conductors 505 include an inner core of conductors 510 that carry power and signals to and from the receive array 150 in an aft direction. The inner core of conductors 510 includes multiple conductors, such as fiber optics for data communications. The inner core of conductors 510 passes through the tow ball 500 substantially along the center longitudinal axis of the tow ball 500.

The conductors 505 include a layer of breakout conductors 515 that surround the inner core of conductors 510, such as in a concentric manner. The power and signals transmitted to the transmitter of the leading towed body 200 is carried by the layer of breakout conductors 515.

The tow ball 500 includes a plurality (e.g., eleven) of breakout connectors 520. Each breakout connector 520 includes one end that connects to a corresponding conductor and another end that is disposed inside of a pin hole (e.g., pin hole 415 for making electrical contact with a connector in the tow socket 230. In this longitudinal cross-sectional view, two breakout connectors 520 are shown, and each is connected to a breakout conductor 525 from the layer of breakout conductors 515. Accordingly, inside of the tow ball, each breakout conductor 525 spreads apart from the inner core of conductors 510 to reach a corresponding breakout connector 520. As shown, the tow ball 500 is pre-wired to the multiple (e.g., eleven) breakout connectors 520 within the tow ball 500 to mate with the same number of rotatable sleeve connectors in the tow socket 230.

The tow ball 500 represents a portion of a single tow cable that further includes a protective/structural/bend limiting member 530 surrounding the layer of breakout conductors 515, such as in a concentric manner. Member 530 can include multiple wires, such as steel wires, or other load bearing sleeving or U-joint components suitable for winching and with standing tension.

Like in FIG. 1, the line C represents the location for the lateral cross-section of the single tow cable, and the circle with an "x" through the center represents a direction into the page for the cross-section cut along the line C.

Figure 6:
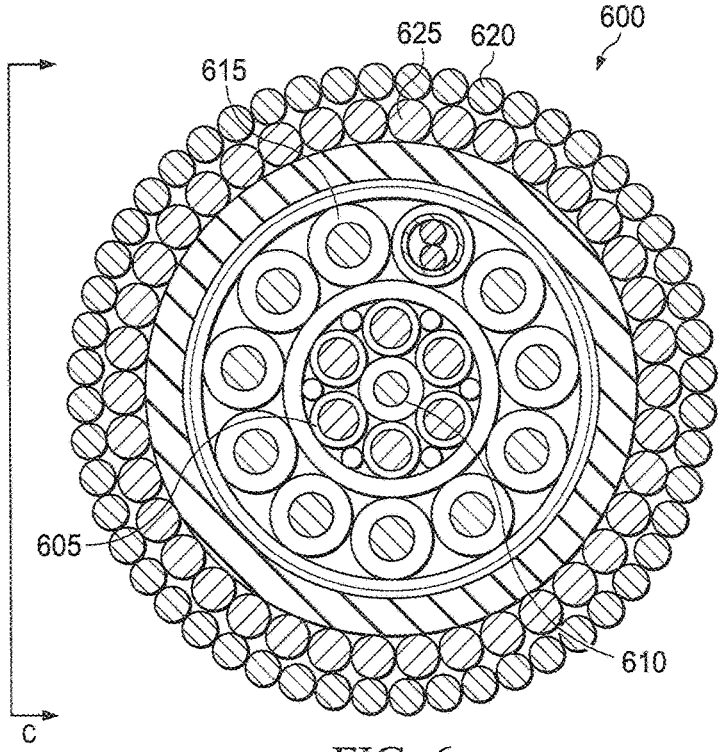
FIG. 6 illustrates a lateral cross-section of an example tow cable according to embodiments of the present disclosure.

FIG. 6 illustrates a lateral cross-section of an example tow cable 600 according to embodiments of the present disclosure. The tow cable 600 is a single cable that can be the same as or similar to the tow cable 110 or 205. For example, the line C represents the location for the lateral cross-section of the tow cable 110. The arrows attached to the line C represent a direction for the cross-section cut along the line C (i.e., the direction represented by the circle with an "x" through the center in FIGS. 1 and 5). A lateral cross section of the second portion 205*b* of the tow cable 205 is similar to or substantially the same as a lateral cross section of the tow cable disposed inside of the forward end of the tow ball 305, 500.

The tow cable 600 includes three concentric layers, namely, an inner core of conductors (e.g., inner core of conductors 510), an intermediate layer of breakout conductors, and a structural member forming an outer layer. In the example shown, the inner core includes six inner conductors 605 arranged in a circular manner surrounding a center conductor 610. The center conductor 610 includes optical fibers configured to carry data communications. More particularly, the center conductor 610 carries a SONAR signals to and from the vessel 105. In certain embodiments, the inner conductor 605 can have the same or similar function as the center conductors 610. In certain embodiments, the center conductor 610 provides structure to the tow cable 110.

In the example shown, intermediate layer of breakout conductors includes a plurality (e.g., eleven) of breakout conductors 615. Each breakout conductor 615 is formed of an electrically conductive material, such as copper, and carries electrical power.

In the example shown, the outer layer structural member includes two sublayers of tension resilient wires. The outer layer includes wires 620 with a smaller diameter than the wires 625 of the penultimate layer.

Note that components 605 and 610 of the inner core, components 615 of the intermediate layer, and components 620-625 of the outer layer in FIG. 6 could be the same as or similar to corresponding components of the inner core of conductors 510, components 525 of the layer of breakout conductors 515, and the structural member 530 in FIG. 5. These components in FIG. 6 can operate in the same or similar manner as the corresponding components in FIG. 5.

Although FIG. 6 illustrates one example of a tow cable 600, various changes may be made to FIG. 6. For example, the relative sizes, shapes, and dimensions of the various components shown in FIG. 6 are for illustration only. Each component in FIG. 6 could have any other size, shape, and dimensions. As another example, the intermediate layer can include any suitable number of breakout conductors 615, so long as the number matches the number of pin holes 415 in the tow ball 305, 500 or number of pin holes 420 in the tow ball receiver 405.

Figure 7A:
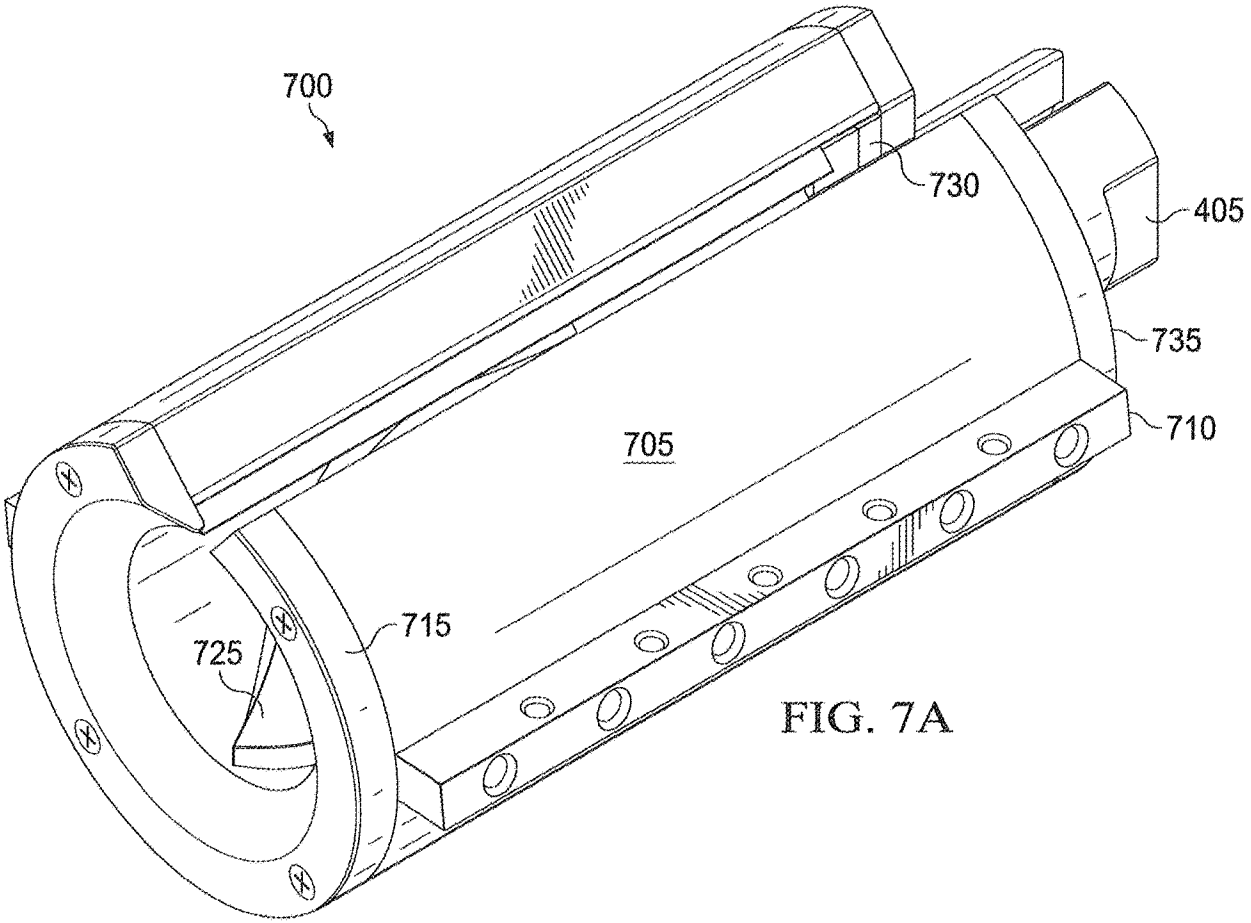
FIGS. 7A and 7B illustrate an example aft tow point socket according to embodiments of the present disclosure.
Figure 7B:
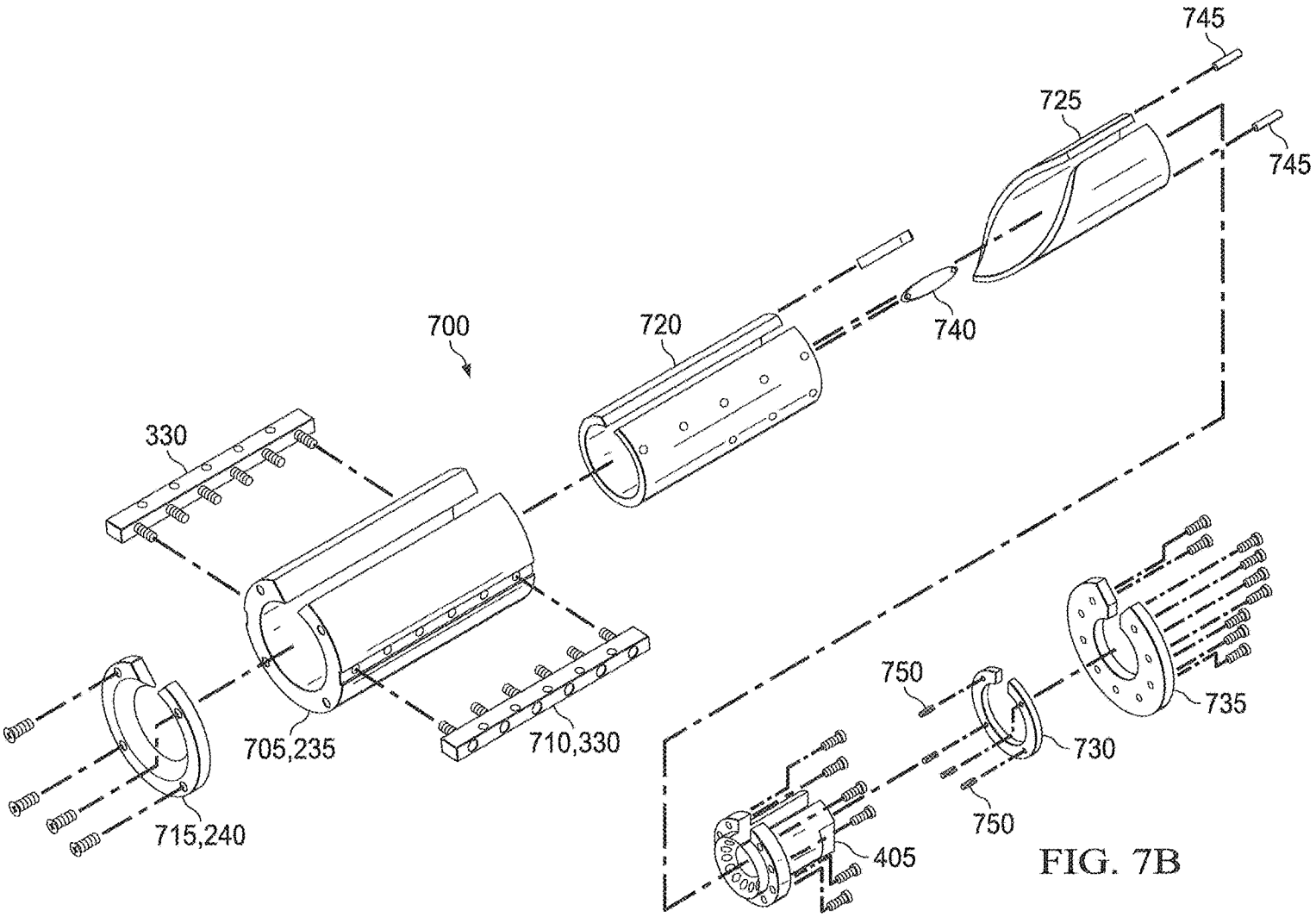

FIGS. 7A and 7B illustrate an example aft tow point socket 700 (hereinafter referred to as "tow socket") according to embodiments of the present disclosure. FIG. 7A shows an assembly view of the tow socket 700. FIG. 7B shows an exploded view of the tow socket 700. FIGS. 7A and 7B will be described together.

The tow socket 700 includes an outer housing 705, a mount rail 710 on each side of the outer housing 705, a front plate 715 fastened to a front of the outer housing, and other external components. The outer housing 705 extends from the front plate 715 to the back plate 735. The tow socket 700 also includes internal components housed within the outer housing 705. The internal components include a rotation sleeve 720, a rotation cam 725, the tow ball receiver 405 (shown in FIG. 4), a thrust washer 730, a back plate 735, a guide cam 740, dowel pins 745, a slotted spring pin 750, various fasteners, and other internal components. The slotted spring pin 750 limits the necessary cam action to a maximum rotation of about 180°.

The tow socket 700 could, for example, be used with the towing system 100 of FIG. 1 and the leading towed body 200. Note that components 700, 705, and 715 in FIGS. 7A and 7B could be the same as or similar to corresponding components 210, 235, and 240 in FIG. 2. These components in FIGS. 7A and 7B can operate in the same or similar manner as the corresponding components in FIG. 2.

Figure 8A:
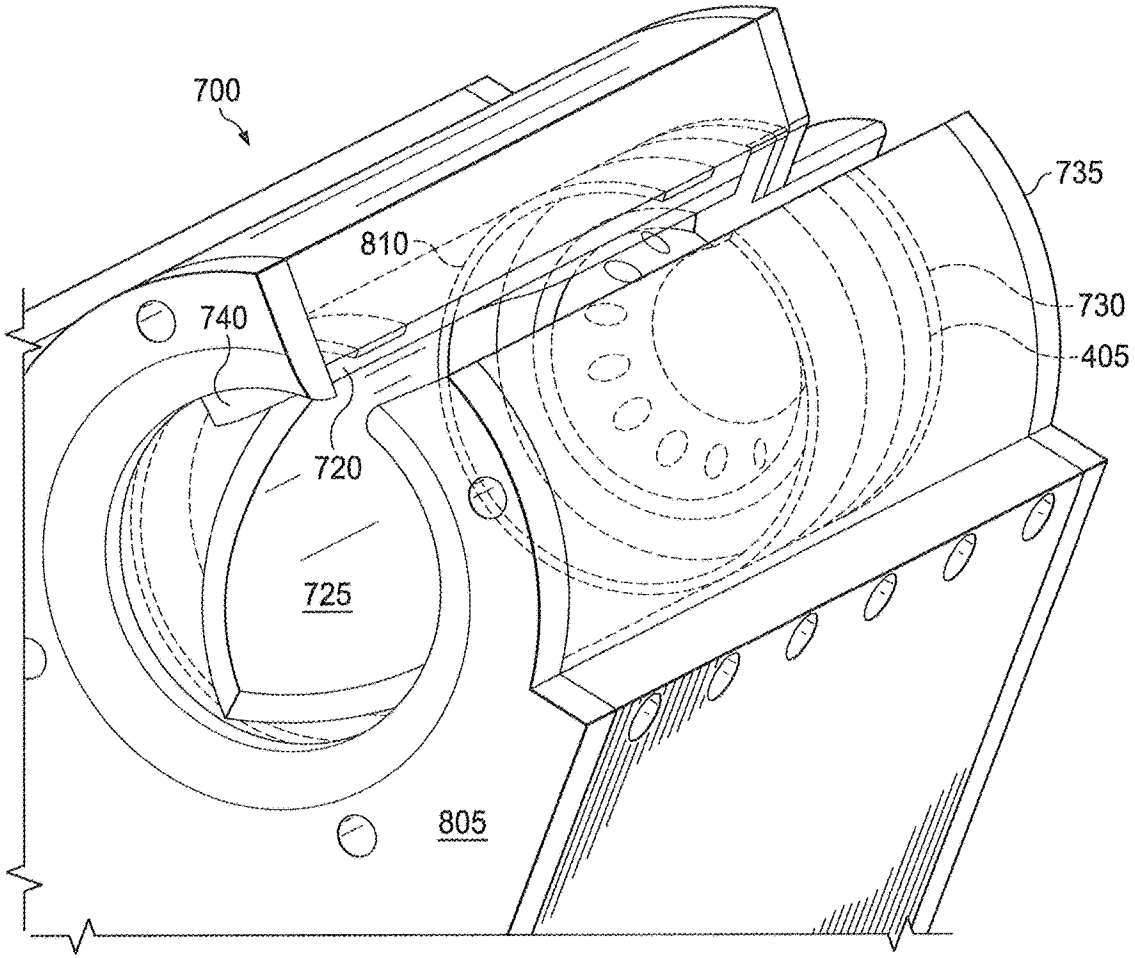
FIGS. 8A and 8B illustrate a solid assembly view of the tow socket of FIGS. 7A and 7B mounted to an aft tow point.
Figure 8B:
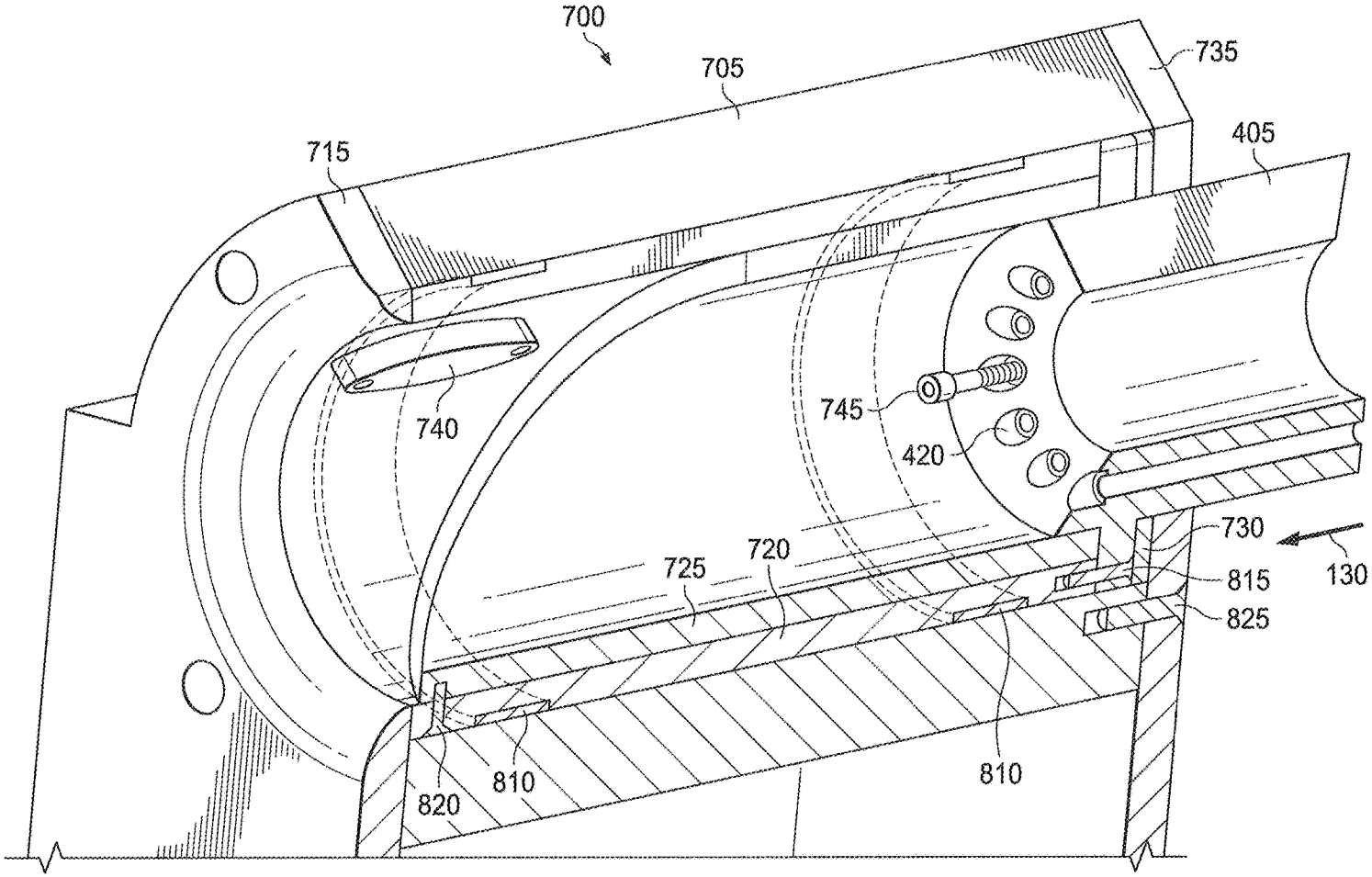

FIGS. 8A and 8B illustrate a solid assembly view of the tow socket 700 of FIG. 7 mounted to an aft tow point 805. FIG. 8A shows a perspective view of the tow socket 700. FIG. 8B shows a cross-sectional view of the tow socket 700. FIGS. 8A and 8B will be described together. For ease of explanation, the tow socket 700 is described as being a component of the leading towed body 200 of FIG. 2. Note that the aft tow point 805 could be the same as or similar to the aft tow point 225 in FIG. 2.

As shown, the rotation sleeve 720 wedge cut out is on top and aligned with the wedge cut out of the outer housing 705, which is the position for top-down cable entry into the center of the tow socket 700.

The internal components of the tow socket 700 are arranged symmetrically about its longitudinal center axis and at various radial distances from the longitudinal center axis. The outer housing 705 forms an outer fixed sleeve that does not move relative to the aft tow point 805. Multiple (e.g., two) low friction rings 810 are disposed between the rotation sleeve 720 and the internal surface of the outer housing 705 to enable the rotation sleeve 720 to rotate either clockwise or counterclockwise with low friction between the two surfaces. In certain embodiments, the low friction rings 810 are flush with the outer surface of the rotation sleeve 720 and do not extend radially outward beyond the outer circumference of the rotation sleeve 720. The low friction rings 810 can be composed of material such as Teflon or nylon. Alternatively, surface treatments applied to the rotation sleeve 720 or inner surface of the outer housing 705 can provide low rotational resistance.

The guide cam 740 holds front low friction ring 810 in a fixed location relative to the front and back of the rotation sleeve 720. That is, the guide cam 740 is fixed to an internal surface of the rotation sleeve 720. The guide cam 740 is disposed radially within the rotation sleeve 720 in a same concentric layer as the rotation cam 725. The guide cam 740 prevents the cam follower 345 on tow ball 305 from jamming when the tow cable 205 is not well aligned axially with socket assembly 700 prior to tow ball 305 insertion.

The tow ball receiver 405 forms the inner most concentric layer of the tow socket 700. The inner circumference of the tow ball receiver 405 is sufficient for the inner core of conductors (e.g., inner core of conductors 510) to pass through. In certain embodiments, the inner circumference of the tow ball receiver is wider than the outer circumference of the inner core (e.g., a conduit including the inner conductors 605) by a clearance distance. Near the rear of the outer housing 705, the rotation cam 725 is disposed radially between the tow ball receiver 405 and the rotation sleeve 720. More particularly, the front of the tow ball receiver 405 that includes the entrance to the pin holes 420 has an outer circumference corresponding to the inner circumference of the rotation cam 725. The tow ball receiver 405 extends in an aft direction from its front to a distance beyond the back plate 735, and each pin hole 420 extends the entire length of the cylinder portion of the tow ball receiver 405. The tow ball receiver 405 includes a flange near its front, and the flange protrudes radially outward from the outer circumference of the cylinder portion of the tow ball receiver 405.

The fasteners 815 extend through and fasten the flange of the tow ball receiver 405 to the rotation sleeve 720. Accordingly, the tow ball receiver 405 rotates together in unison with the rotation sleeve 720 while remaining in a fixed orientation relative to the rotation sleeve 720.

The fasteners 820 extend through and fasten the rotation sleeve 720 to the rotation cam 725. Accordingly, the rotation cam 725 rotates together in unison with the rotation sleeve 720 while remaining in a fixed orientation relative to the rotation sleeve 720. That is, the rotation sleeve 720, the rotation cam 725, and the tow ball receiver 405 are fixed in orientation relative to each other and rotate as a unit.

Fasteners 825 extend through and fasten the back plate 735 to the outer housing 705. Accordingly, the back plate 735 remains in a fixed orientation relative to the outer housing 705 and the aft tow point 805.

The thrust washer 730 is disposed longitudinally between the back plate 735 and the rear face of the flange of the tow ball receiver 405. The thrust washer 730 has an outer circumference substantially the same as the outer circumference of the rotation sleeve 720, and has an inner circumference substantially the same as the outer circumference of the rear portion of tow ball receiver 405.

Although FIG. 8 illustrates one example of a tow socket 700, various changes may be made to FIG. 8. For example, the relative sizes, shapes, and dimensions of the various components shown in FIG. 8 are for illustration only. Each component in FIG. 8 could have any other size, shape, and dimensions. As another example, the tow socket 700 could include flexible pigtails (shown in FIGS. 10B and 11B as reference number 1005) from a back side of the tow ball receiver 405.

Figure 9:
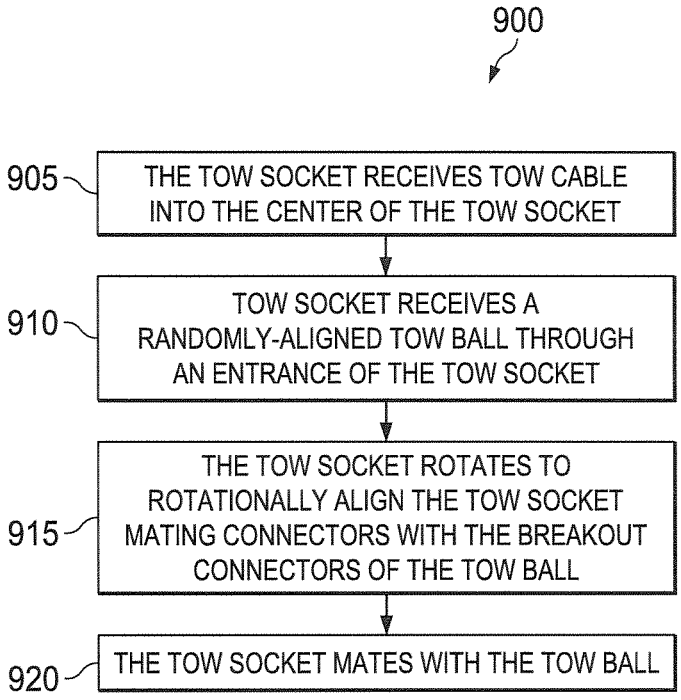
FIG. 9 illustrates a method of engaging an ABA according to embodiments of the present disclosure.

FIG. 9 illustrates a method 900 of engaging an ABA according to embodiments of the present disclosure. For ease of explanation, the method 900 will be described as being implemented by the ABA 210.

In block 905, the tow socket 230 receives the tow cable 205 into the center of the tow socket 230. More particularly, at the start of the method 900, the wedge notch cutout at a top position that is approximately a 12 o'clock position. The wedge notch cutout of the internal components (i.e., rotation sleeve 720, rotation cam 725, and tow ball receiver 405) are rotationally aligned with the wedge notch cutout of the outer housing 235 in order for the tow cable 205 to be lowered in the center. The third portion 205*c* of the tow cable 205 is initially above the tow socket 230, and gets lowered into the wedge notch cutout of the outer housing 235 and internal components by an automated process.

In block 910, the randomly-aligned tow ball 305 passes through the entrance of the tow socket 230. That is, the tow socket 230 receives the tow ball 305 at the random orientation. More particularly, once the third portion 205*c* of the tow cable 205 is disposed within the center of the tow socket 230, a winching operation moves the tow cable 205 such that the tow ball 305 moves in the aft direction.

In block 915, the tow socket 230 rotates to rotationally align the tow socket pin holes 420 (including corresponding tow socket connectors therewithin) with the pin holes 415 (including corresponding breakout connectors 520) of the tow ball 305. More particularly, force of the cam follower 345 against the rotation cam 725 drives the rotation sleeve 720, the rotation cam 725, and the tow ball receiver 405 to rotate as a unit to a point of close final alignment. Final precision alignment occurs when two close-tolerance dowel pins 745 engage two (2) tow ball pin holes 415*a* with two (2) tow socket pin holes 420*a* prior to the connectors mating. That is, final precision alignment occurs when an opposite end of a dowel pin 745 that has one end disposed within the tow socket pin hole 420*a* enters the corresponding pin hole 415*a*.

In block 920, the tow socket 230 mates (e.g., electrically couples) to the tow ball 305. That is, conductors 420 within the tow ball receiver 405 each have connectors that form an electrical connection to the intermediate layer conductors 515 within the tow ball 500 through its corresponding connectors.

Although FIG. 9 illustrates one example of method of engaging an ABA 210, various changes may be made to FIG. 9. For example, while shown as a series of steps, various steps in FIG. 9 could overlap, occur in parallel, occur in a different order, or occur any number of times. As another example, a reverse order or the engagement process implements a disengagement process.

Figure 10A:
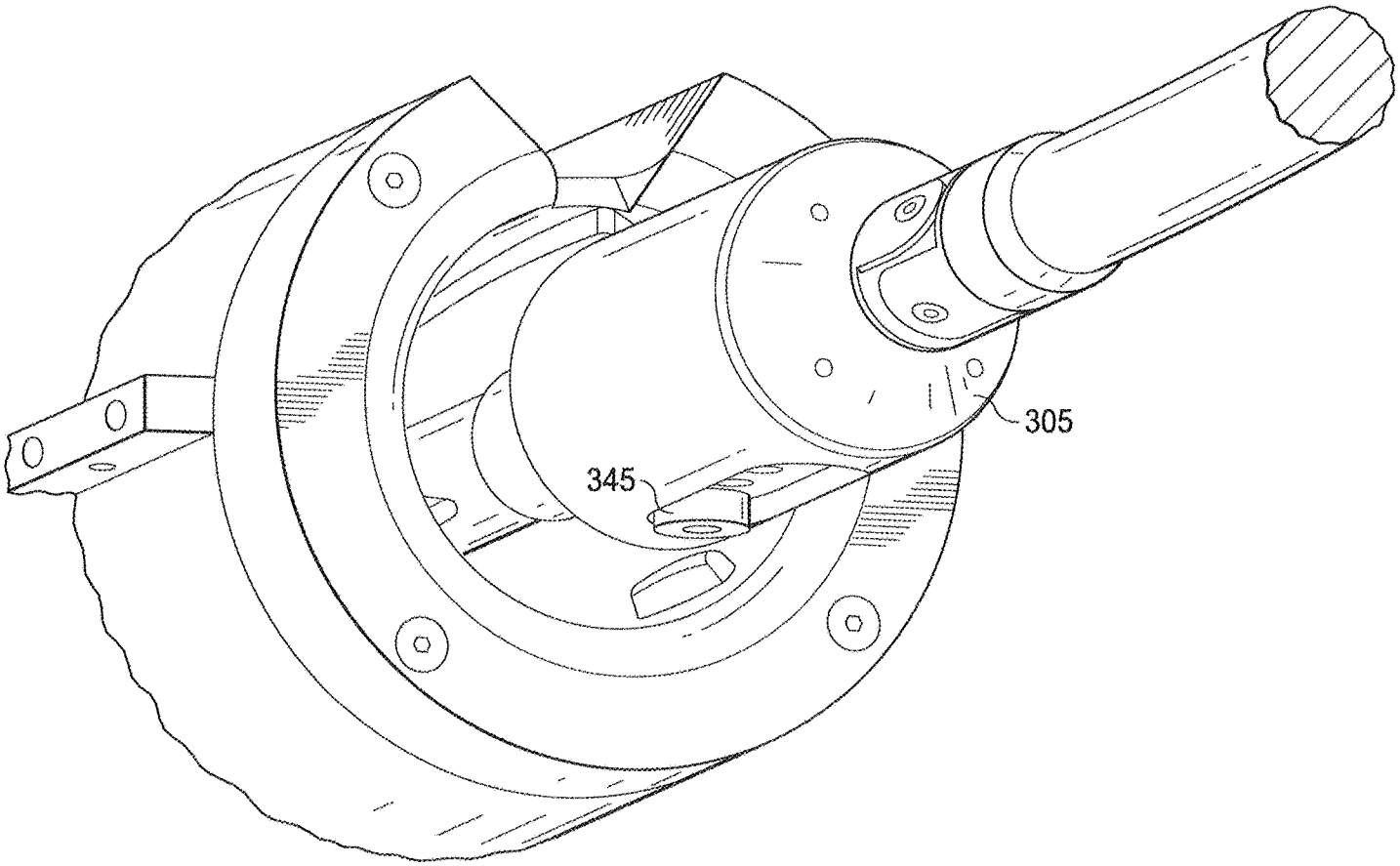
FIGS. 10A through 12C illustrate various operations within the method of engaging an ABA in FIG. 9.

FIGS. 10A through 12C illustrate various operations within method of engaging an ABA in FIG. 9. FIGS. 10A and 10B illustrate the operation of block 905 in FIG. 9. FIG. 10A illustrates the operation of block 905 from a point of view looking at a forward or front face of the tow socket 230 in the aft direction. FIG. 10B illustrates the operation of block 905 from a point of view looking at the rear face of the tow ball receiver 405 of tow socket 230 in the forward direction 130. The tow ball 305 is outside of and forward of the tow socket 230 according to the forward direction 130. The tow ball orientation is initially random relative to the orientation of the tow socket 230. The tow ball connectors are keyed to the cam follower 345, while the tow socket connectors are keyed to the rotation cam 725 and rotation sleeve 720. The flex cable 1005 has slack to rotate clockwise or counter clockwise. The flex cable 1005 provides a connection from the towed body to the rotating sleeve.

Figure 11B:
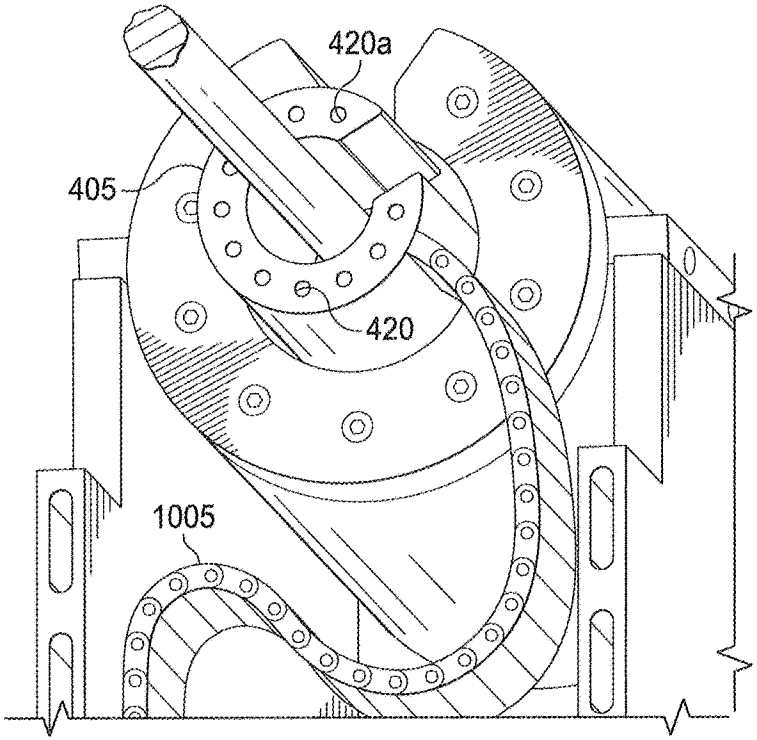
Figure 10B:
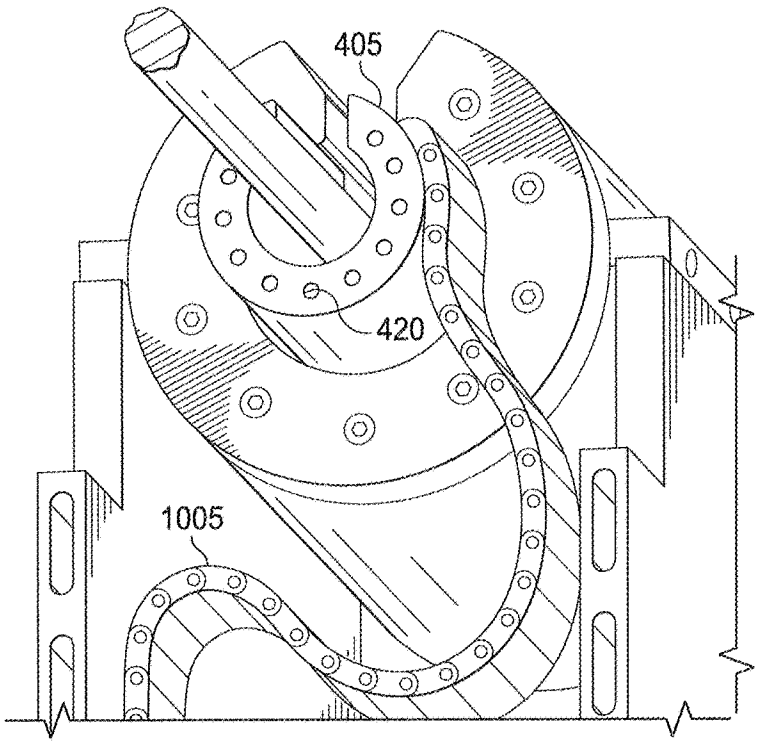
Figure 11A:
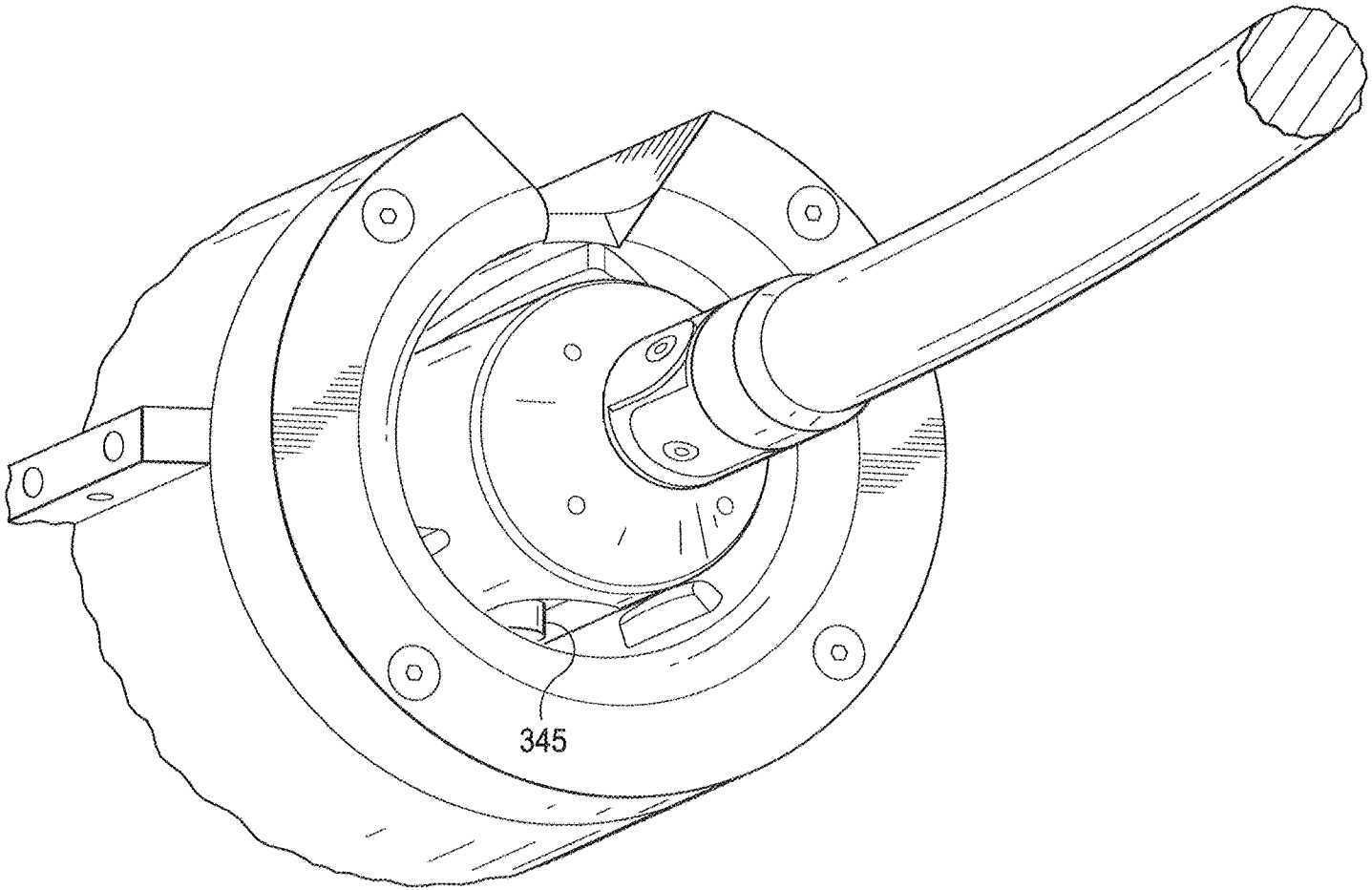

FIGS. 11A and 11B illustrate the operation of block 910 in FIG. 9. FIG. 11A illustrates the operation of block 910 from a point of view looking at a forward or front face of the tow socket 230 in the aft direction. FIG. 11B illustrates the operation of block 910 from a point of view looking at the rear face of the tow ball receiver 405 of the tow socket 230 in the forward direction 130. The cam follower 345 makes surface-to-surface contact with the internal surface of the rotation cam 725, forcing the rotation sleeve 720 to rotate clockwise or counterclockwise based on whether the cam follower 345 contacts a right or left side of the rotation cam 725. In the example shown, the cam follower 345 protrudes leftward (looking aft) as it contacts the left side of the rotation cam 725, and as a result, the tow ball receiver 405 rotates counterclockwise (looking aft).

Figure 12A:
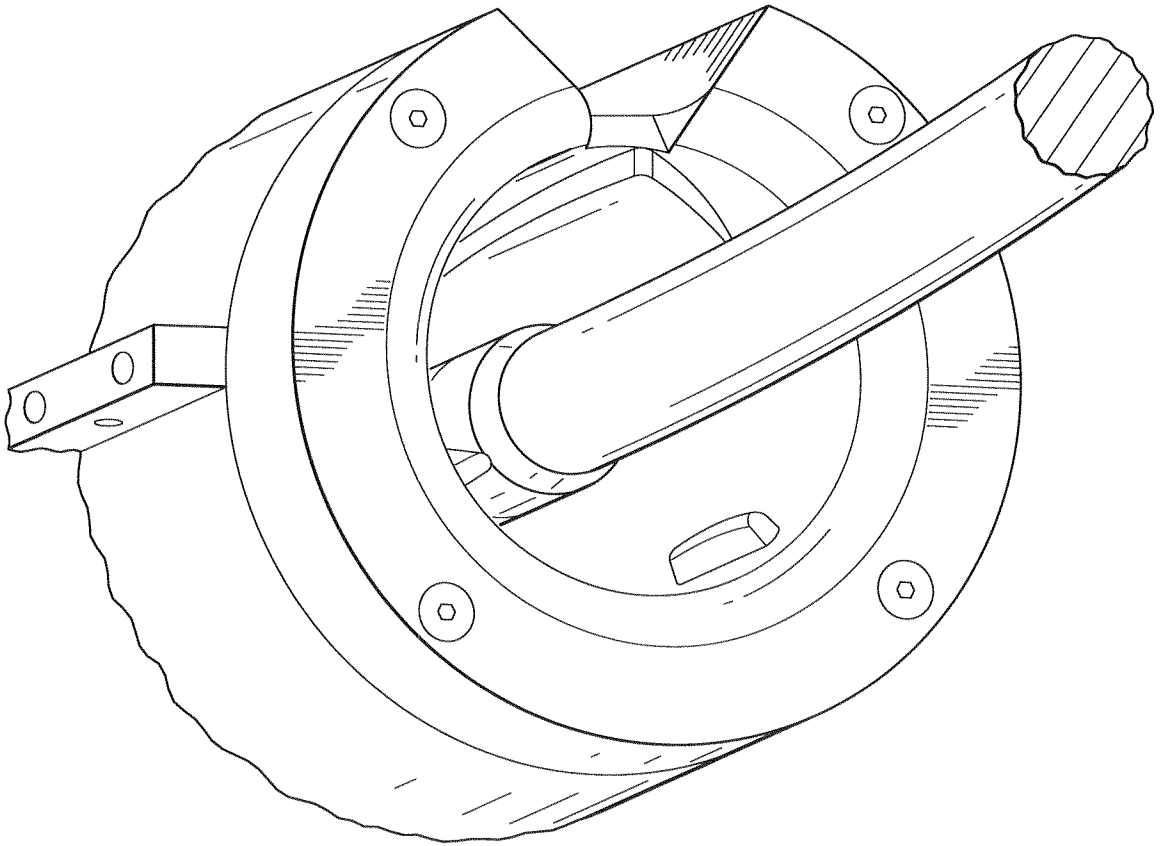
Figure 12C:
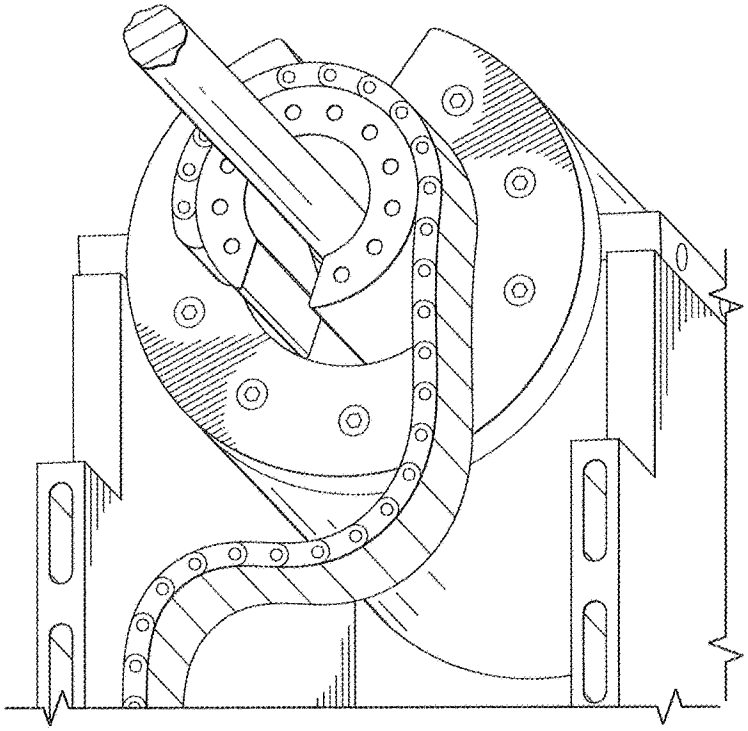
Figure 12B:
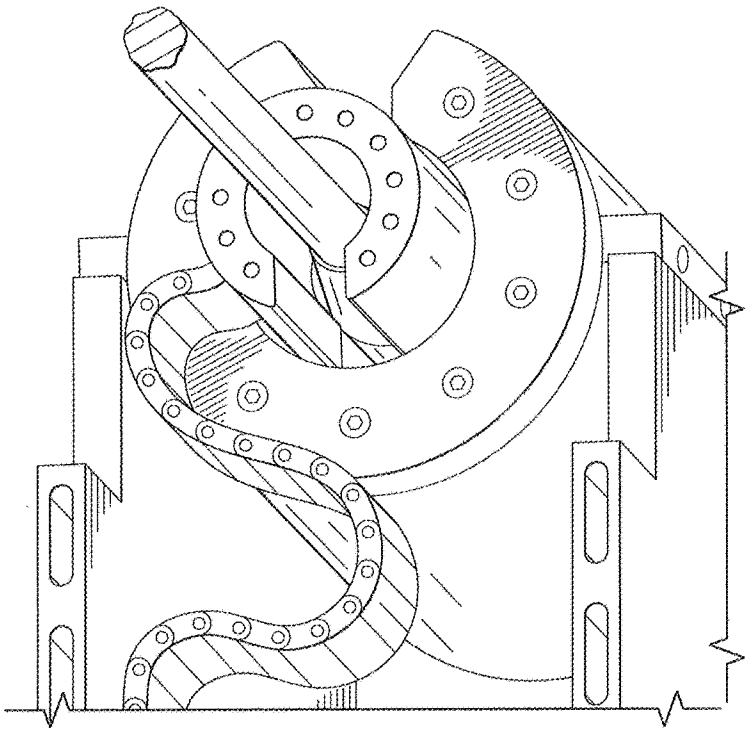

FIGS. 12A, 12B, and 12C illustrate the operation of block 920 in FIG. 9. FIG. 12A illustrates the operation of block 920 from a point of view looking at a forward or front face of the tow socket 230 in the aft direction. FIGS. 12B and 12C illustrates the operation of block 920 from a point of view looking at the rear face of the tow socket 230 in the forward direction 130, wherein the flex cable 1005 wraps clockwise and counterclockwise, respectively. The aft end of the tow ball 305 bears on the tow ball receiver 405 of tow socket 230 as a result of tension on the third portion 205*c* of the tow cable. The flex cable 1005 wraps zero to 180° in the clockwise or counter clockwise direction.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

What is claimed is:

1. A system comprising:

a body comprising a tow socket configured to receive a randomly-aligned tow ball, the tow socket having a rotatable sleeve, a cam, and multiple mating connectors, each mating connector electrically coupled to an electrical conductor; and a cable configured to be coupled to the body in order to facilitate towing of the body, the cable comprising multiple core connectors and multiple breakout connectors configured to transport signals, wherein the cable further comprises a tow ball configured to enter the rotatable sleeve of the tow socket, the tow ball comprising connectors configured to couple the breakout connectors of the cable to the mating connectors of the tow socket, wherein the cam is coupled to the rotatable sleeve and configured to rotate the rotatable sleeve to substantially align the mating connectors of the tow socket with connectors of a tow ball such that each electrical conductor electrically coupled to a mating connector couples to a corresponding connector of the tow ball.

2. The system of claim 1, wherein the tow socket further includes a fixed sleeve within which the rotatable sleeve is configured to rotate.

3. The system of claim 2, wherein the fixed sleeve is configured to fixedly attach to the body.

4. The system of claim 1, wherein the cam is further configured to rotate according to a force from physical contact between the cam and cam follower of the tow ball.

5. The system of claim 1, wherein the connectors of the tow ball are configured to pass through electrical conductors and optical conductors.

6. That system of claim 1, wherein the cable includes a structural member and electrical conductors arranged concentrically.

7. The system of claim 1, wherein the tow ball is disposed at a mid-point of the cable.

8. The system of claim 1, wherein the tow socket further comprises:

a slot configured to receive the cable into the rotatable sleeve, and an entrance through which the tow ball enters the rotatable sleeve, wherein the slot is arranged perpendicular to the entrance.

9. The system of claim 1, wherein movement of the cable transfers a tow loading force between the cable and the tow socket.

10. An apparatus comprising:

a tow socket configured to receive a randomly-aligned tow ball, the tow socket having a rotatable sleeve, a cam, and multiple mating connectors, each mating connector electrically coupled to an electrical conductor, wherein the cam is coupled to the rotatable sleeve and configured to rotate the rotatable sleeve to substantially align the mating connectors of the tow socket with connectors of a tow ball such that each electrical conductor electrically coupled to a mating connector couples to a corresponding connector of the tow ball.

11. The apparatus of claim 10, further comprising a fixed sleeve within which the rotatable sleeve is configured to rotate.

12. The apparatus of claim 11, wherein the fixed sleeve is configured to fixedly attach to a body.

13. The apparatus of claim 10, wherein the cam is further configured to rotate according to a force from physical contact between the cam and cam follower of the tow ball.

14. The apparatus of claim 10, wherein the rotatable sleeve is configured to receive the tow ball through an entrance.

15. The apparatus of claim 10, wherein the apparatus is fixedly attached to a body to be towed, and wherein the tow ball is a component of a cable that is configured to be coupled to the body in order to facilitate towing of the body, the cable comprising multiple core connectors and multiple breakout connectors configured to transport power and signals.

16. The apparatus of claim 10, wherein movement of the cable transfers a tow loading force between the cable and the tow socket.

17. A method comprising:

receiving, by a tow socket having a rotatable sleeve and multiple mating connectors, a cable into the tow socket through a slot, wherein the cable comprises a tow ball, and wherein each mating connector is electrically coupled to an electrical conductor;

receiving, by the rotatable sleeve, the tow ball through an entrance;

rotating a cam to rotate the rotatable sleeve to substantially align the mating connectors of the tow socket with connectors of the tow ball such that each electrical conductor electrically coupled to a mating connector couples to a corresponding connector of the tow ball; and transferring a tow loading force between the cable and the tow socket by moving the cable.

18. The method of claim 17, wherein the cam is further configured to rotate according to a force from physical contact between the cam and cam follower of the tow ball.

19. The method of claim 17, further comprising coupling the connectors of the tow ball with the mating connectors of the tow socket.

20. The method of claim 17, wherein the slot is arranged perpendicular to the entrance.

* * * * *